US006472837B1

(12) United States Patent
Caporalin et al.

(10) Patent No.: US 6,472,837 B1
(45) Date of Patent: Oct. 29, 2002

(54) MULTIPOLAR ELECTROMAGNETIC SWITCHING MODULE

(75) Inventors: Yann Caporalin, La Frette sur Seine (FR); Bernard Fournier, Le Plessis Bouchard (FR); Xavier Person, Vertus (FR); Jean-Marc Romillon, Longnes (FR)

(73) Assignee: Schneider Electric Industries SA, Rueil-Malmaison (FR)

( * ) Notice: Subject to any disclaimer, the term of this patent is extended or adjusted under 35 U.S.C. 154(b) by 0 days.

(21) Appl. No.: 09/625,964

(22) Filed: Jul. 26, 2000

Related U.S. Application Data

(63) Continuation of application No. 09/597,783, filed on Jun. 19, 2000, now Pat. No. 6,304,049.

(30) Foreign Application Priority Data

Jun. 18, 1999 (FR) ..... 99 07879
May 2, 2000 (FR) ..... 00 05670

(51) Int. Cl.[7] ..... H01H 67/00
(52) U.S. Cl. ..... 318/520; 307/127; 307/143
(58) Field of Search ..... 318/519, 520, 318/767, 771, 772, 778; 307/112, 113, 116, 125, 126, 127, 139, 140, 143

(56) References Cited

U.S. PATENT DOCUMENTS 4,803,587 A * 2/1989 Fournier et al. ..... 361/24
4,937,403 A * 6/1990 Minoura et al. ..... 200/50 AA
4,994,725 A * 2/1991 Gschlossl ..... 318/727
5,247,236 A * 9/1993 Schroeder ..... 318/794
5,481,073 A * 1/1996 Singer et al. ..... 200/1 R

* cited by examiner

*Primary Examiner*—Bentsu Ro
(74) *Attorney, Agent, or Firm*—Oblon, Spivak, McClelland, Maier & Neustadt, P.C.

(57) ABSTRACT

The present invention relates to a multipolar electromagnetic switching module designed to be connected by line connections (t1, t2, t3) to a main electromagnetic switching device (AP) and by load connections (U, V, W, u, v, w) to at least one motor and having, in a unit (Bo), between said connections, several load paths fitted with switching poles whose contacts are always alternately closed and controlled by a switching electromagnet (EI) driven by a control circuit, each of the switching poles (C1, C2, C3) consisting of a movable contact holder (Pc) between two conductors (Cf1, Cf2) bearing fixed contacts characterized in that, for each pole, the movable contact holder (Pc) comprises two parallel loop-shaped conductors (Cm1, Cm2) connected to a connection (T1, T2, T3) and that the two fixed contact parts (Cf1, Cf2) are loop-shaped and connected to connections (U, V, W).

11 Claims, 4 Drawing Sheets

MULTIPOLAR ELECTROMAGNETIC SWITCHING MODULE

This application is a Continuation of application Ser. No. 09/596,783 Filed on Jun. 16, 2000, now U.S. Pat. No. 6,304,049 B1.

The present invention relates to a multipolar electromagnetic switching module designed to be connected by line connections to a main multipolar electromagnetic switching device and by load connections to at least one motor and having, in a unit, between said connections, several load paths fitted with switching poles whose contacts are always alternately closed and controlled by a single switching electromagnet driven by a control circuit, each of the switching poles consisting of a movable contact holder between two conductors bearing the fixed contacts.

The construction of motor control circuits consisting of reverser, star-delta starter, speed-changing mechanism, etc.) is known by combining several devices (contactors, etc.) whose power supplies and control systems are interconnected to create the desired circuit. But this type of system is bulky.

French patents FR 2,758,903 and FR 2,761,521 disclose a reverser-type module capable of switching a motor from forward to reverse operation and vice-versa. This module is also bulky.

The aim of the present invention is to achieve an electromagnetic switching module comprising a switching chamber and single trigger switching poles with enhanced electromagnetic properties. The switching poles always remain closed outside switching in a particularly effective way due to the electromagnetic properties of said poles and the layout of the switching chamber.

The switching module according to the invention is characterized in that, for each pole, the movable contact holder comprises two parallel loop-shaped conductors connected to a connection and that the two fixed contact components are loop-shaped and connected to connections.

The invention will now be described in more detail with reference to embodiments given as examples and shown in the attached figures, wherein.

The electromagnetic switching device of the invention, marked M in the figures, is designed to operate in conjunction with a multipolar electromagnetic switching device Ap that may include a contactor- or contactor/circuit-breaker-type motor-protection device. It may be included, together with devices like Ap, in standard circuits such as reversers, star-delta starter systems, distribution systems and speed-changing mechanisms.

In a unit, main switching device Ap houses polar power lines disposed between line connections L1, L2, L3 connected to the phases of the AC power supply and load connections T1, T2, T3 that may be connected to switching module M. Each power line has a switch or pole I1, I2 or I3 controlled by main electromagnet E, the coil B of which is powered by two power supply connections A1 and A2.

Switching module M is housed in a unit Bo the rear of which is provided with a more or less plane fastening base P enabling it to be fastened to a rail or plate. It has line (power) connections t1, t2, t3 connected directly to the downstream connections T1, T2, T3 of main device Ap and output or load (power) connections U, V, W and u, v, w connected to the motor or motors.

Switching module M may be mounted directly under device Ap or it may be offset.

The power lines running between line connections t1, t2, t3 and the output or load connections are fitted with single bistable trigger switching poles C1, C2, C3. These poles C1, C2, C3 are activated by a bistable electromagnet EI fitted with a coil Bb and their contacts are always alternately closed except during switching. Module M has no arc extinction device and cannot therefore be operated under load. The number of connections t1, t2, t3 is equal to the number of connections T1, T2, T3, the number of poles C1, C2, C3 also being equal to or less than this number of connections.

Poles C1, C2, C3 and the internal wiring Sc of the associated power lines perform a standard motor control function: reverser, star-delta or distribution, low-speed/high speed. The wiring of the power circuit of module M is dependent on the control function performed by this module.

Figure 1:
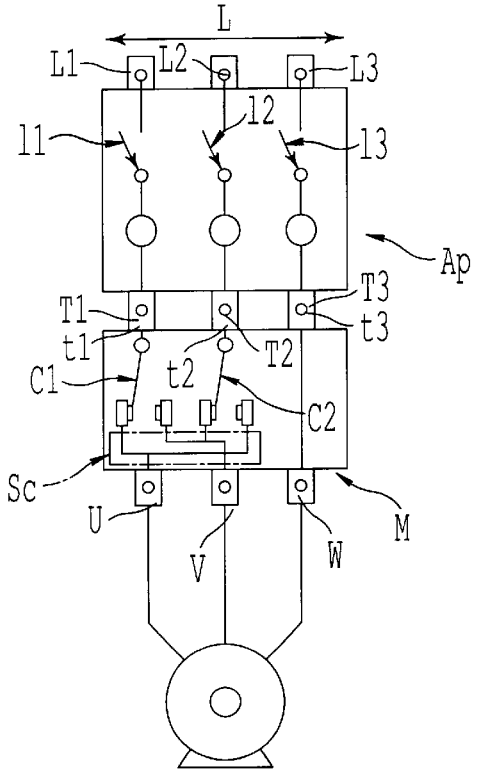
FIG. 1 is a circuit diagram of a reverser-type switching module associated with a main switching device.

In the reverser embodiment shown in FIG. 1, line connection t3 is connected directly to load connection W. Line connections t1 and t2 are connected (forward operation) to load connections U and V via poles C1, C2 and after switching the same poles (reverse operation) to connections V and U, thereby achieving the usual crossing of the phases.

Figure 2:
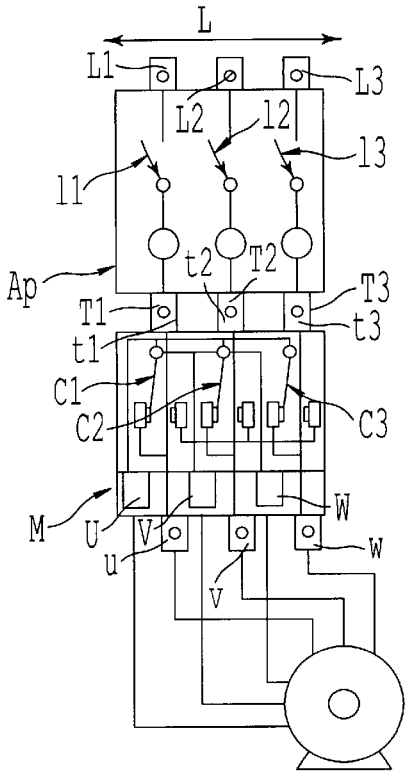
FIG. 2 is a circuit diagram of a star-delta switching module associated with a main switching device.
Figure 3:
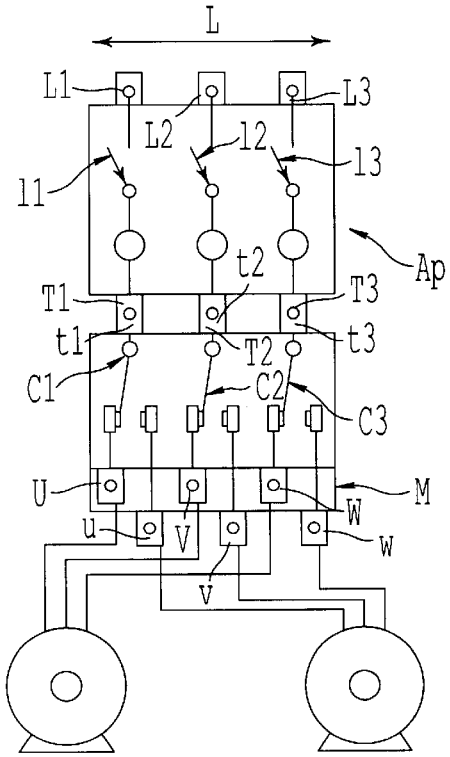
FIG. 3 is a circuit diagram of a distributor-type switching module associated with a main switching device.
Figure 4:
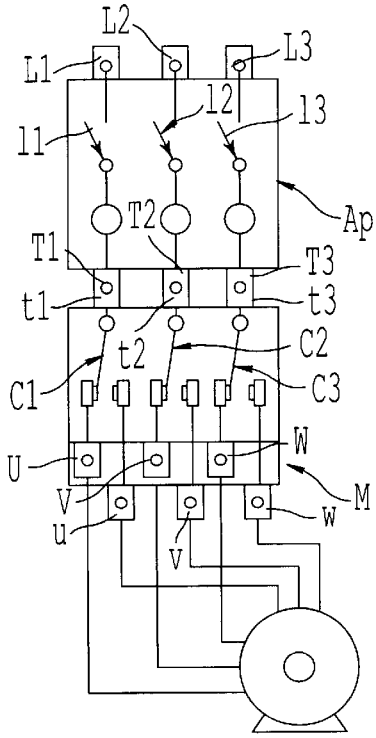
FIG. 4 is a circuit diagram of a speed-changing-type switching module associated with a main switching device.
Figure 5:
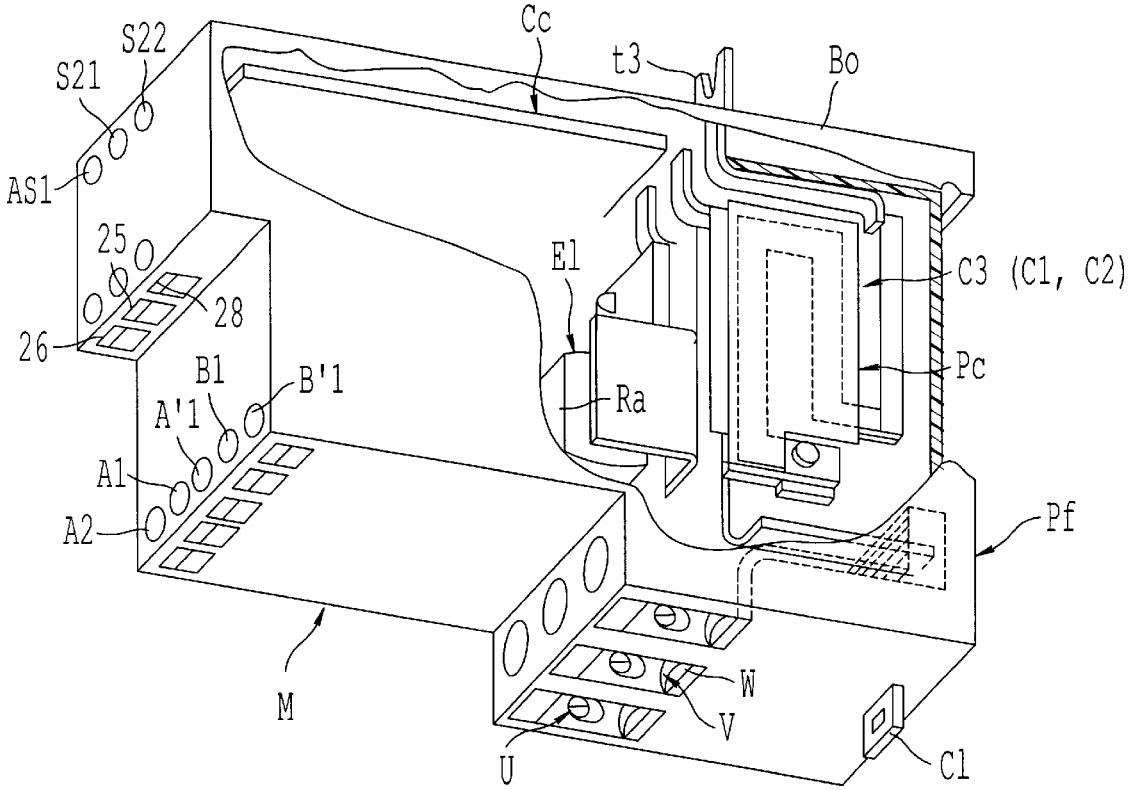
FIG. 5 is an exploded perspective view showing the internal arrangement of a module according to the invention.

In the embodiments shown in FIGS. 2, 3 and 4 designed respectively to effect star-delta start-up, distribution and change of speed, line connections t1, t2, t3 are disposed on one side of the module while load connections U, V, W (star-delta, first motor or high-speed start-up) and load connections u, v, w (star-delta, second motor or low-speed start-up) are disposed on the other side. Connections U, V, W and connections u, v, w are offset relative to one another.

Bistable-type electromagnet EI, which is housed inside switching module M and operates the movable contacts of switching poles C1, C2, C3, is fitted with a permanent magnet designed to reduce energy consumption. Said electromagnet EI is driven by the internal control circuit Cc shown in FIG. 10. The movable magnetic section of electromagnet EI, which has an alternating rectilinear movement, moves switching poles C1, C2, C3 by means of a slider Ra. The displacement axis of this electromagnet is preferably parallel to fastening plane Pf and the connections.

Switching module M is constructed so that switching poles C1, C2, C3 and the associated circuits, together with the control assembly of the poles constituted by electromagnet EI and control circuit Cc are offset or spaced in a direction perpendicular to rear fastening surface Pf of the module, and so that the width L of the module is more or less equal to the width of the associated main switching device Ap. Width L is therefore less than that of standard devices performing similar functions. Switching poles C1, C2, C3 and conductors Sc of the circuit (reverser, etc.) are housed towards the rear, electromagnet EI and associated control circuit Cc being housed forward.

Figure 6:
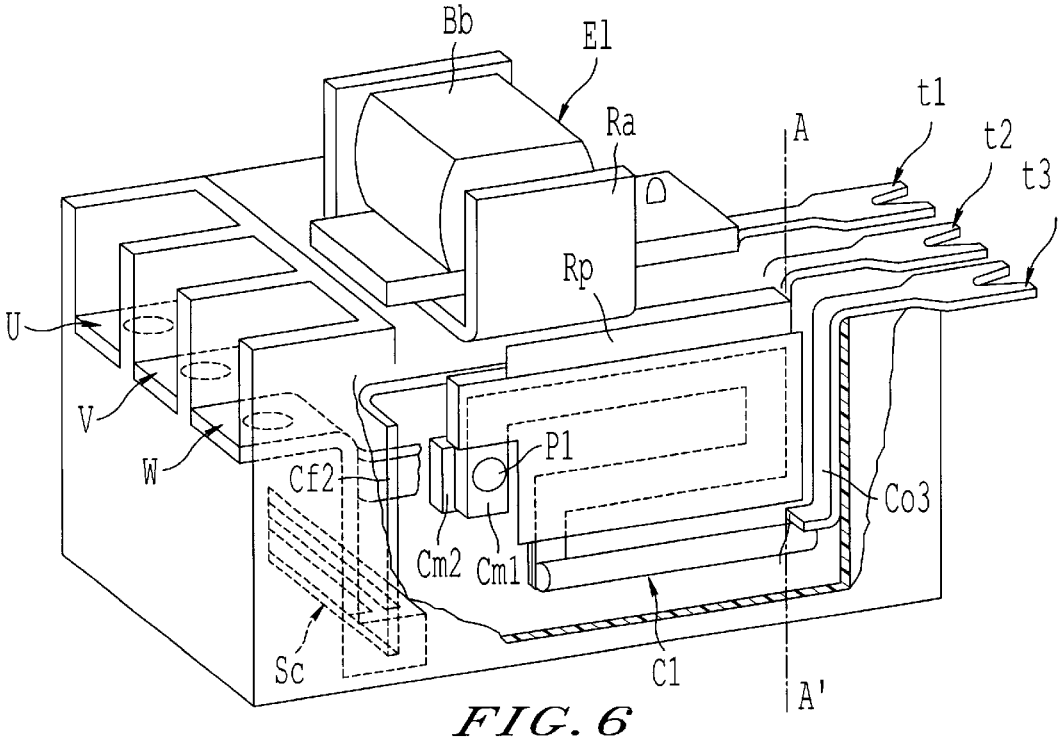
FIG. 6 is a perspective view of the lower section of the module that performs switching to the power circuit.
Figure 7:
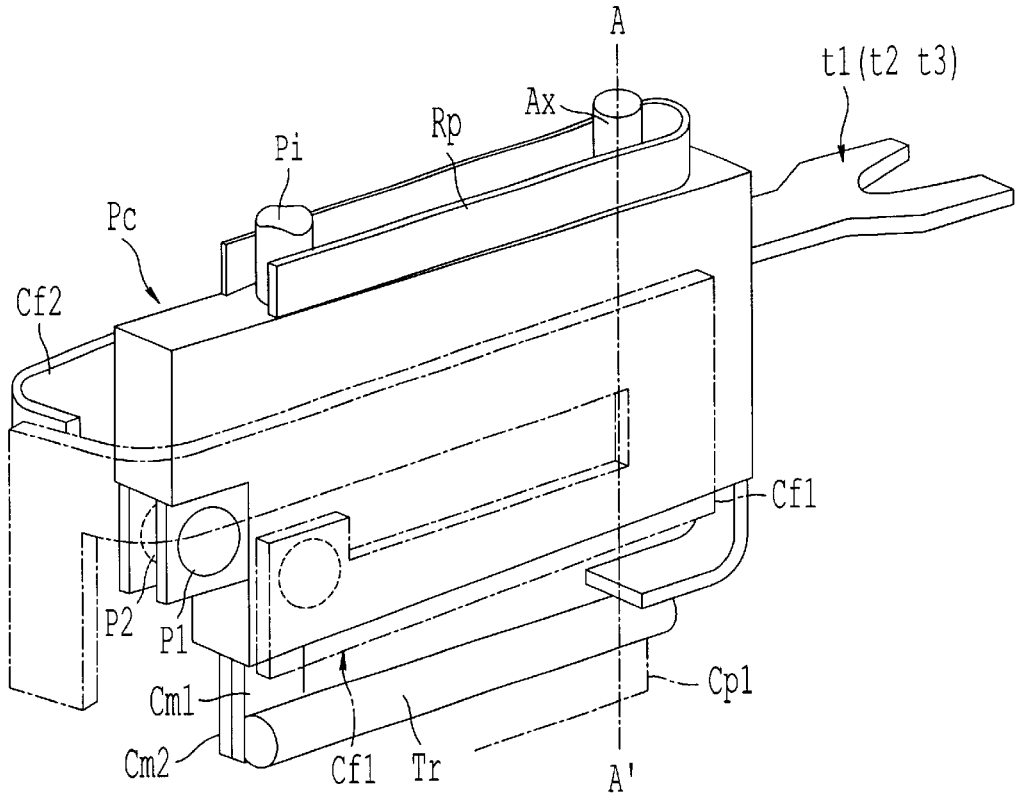
FIG. 7 is a diagram of a switching pole of the module.
Figure 8:
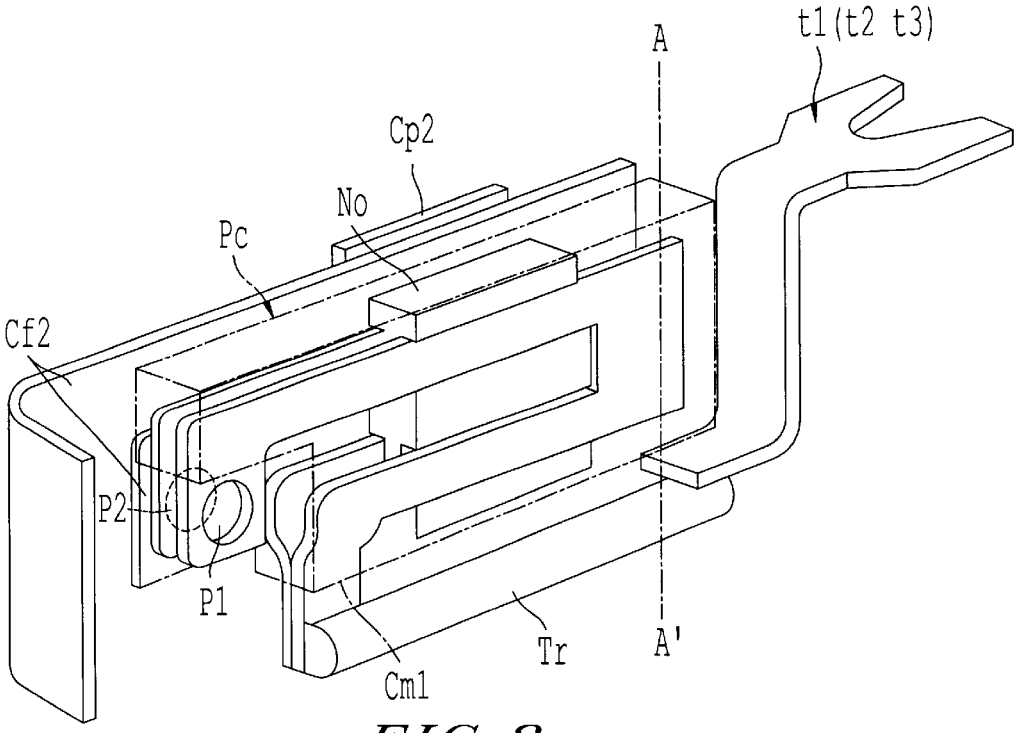
FIG. 8 is a detailed view of the pole in which the power line of one of the fixed contacts is not shown.
Figure 9:
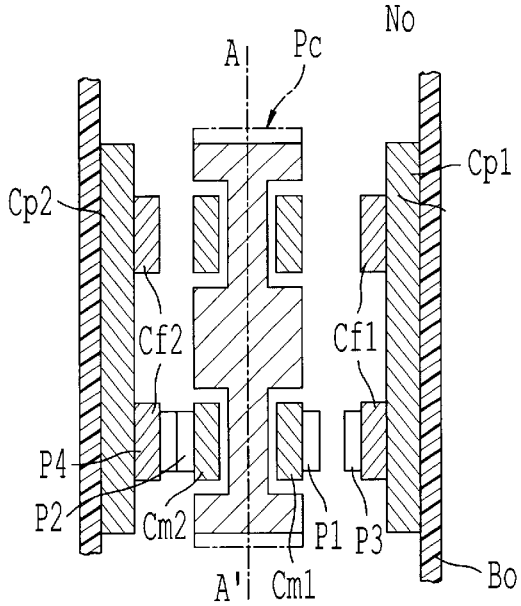
FIG. 9 is a cross-section through P of FIG. 8.

Each switching pole C1, C2 or C3 shown schematically in FIG. 6 is of the reverser type (i.e. the contacts are always closed) and consists of a movable contact holder Pc bearing two loop-shaped parallel conductors Cm1, Cm2 bearing movable contacts P1 and P2 respectively. These conductors meet at a connection t1, t2, t3. Contact holder Pc oscillates around a pin Ax and an axis A–A' between two conductors Cf1, Cf2 bearing fixed contacts P3 and P4. These conductors are also loop-shaped and connected to one or two connections U, V, W. In the embodiment shown the axes are perpendicular to rear fastening plane Pf.

Movable contact-holder Pc oscillates around axis A–A' between a first operating position in which the contacts are closed and a second operating position in which the contacts are also closed. The current passing through movable conductor Cm1 or Cm2 and in parallel directions through the corresponding fixed conductor Cf1 or Cf2 produces a magnetic attraction force. This loop effect produces a contact pressure that is proportional to the current flowing through the pole. The poles are never activated under load, thereby making it possible to reduce nominal contact pressure and therefore the size of the electromagnet required.

The movable sections of the electromagnet drive a slider Ra that moves in translation parallel to rear fastening plane Pf by acting on each pole spring Rp via a component Pi.

Fixed conductors Cf1, Cf2, together with extensions or additional conductors ending in load (power) connections U, V, W etc. constitute one of the control circuits Sc of the motor or motors. Said extensions or additional conductors are housed in the load connection side of unit Bo.

Movable conductors Cm1, Cm2 of contact-holder PC are far enough apart from one another to enable a magnetic core No to be housed between them. Said magnetic core No operates in conjunction with counterplates Cp1, Cp2 fastened inside the switching chamber housing the pole. The movable contact parts Cm1, Cm2 are connected by a flexible electrical link Tr and a conductor such as Co3 to a line connection such as t3.

The control input and output connections are disposed forward. Input connections A2, A1, A1', B1, B1' are designed to receive the motor command signals and the output connections SA1, S21, S22 operate in conjunction with the associated main switching device Ap.

Main switching device Ap comprises a locking contact Ve activated by the movable section of electromagnet E and connected to two connections 21 and 22 that can be connected to connections SA1 and SA2 of module M.

Coil Bb of electromagnet EI is powered so that it is polarized in one direction or the other. This command may be achieved by two auxiliary reverser contacts 1*a* and 1*b* that are activated by the movable section of bistable electromagnet EI and associated with diodes 7*a*, 7*b*. Switching module M may comprise other auxiliary contacts such as 3 and 6 that are also activated by the movable section of electromagnet EI.

To implement the invention, the contacts Bp1 controlling operation in "direction one" and contacts Bp2 controlling operation in "direction two" are connected to connections A1, A'1, B1, B'1 of switching module M. "Direction one" is understood to mean one of the two operating modes of the module, i.e. direct operation for the reverser or in star mode for star-delta. "Direction two" is understood to mean the second mode, i.e. reverse operation or delta mode.

Operation of the switching module will now be described.

Figure 10:
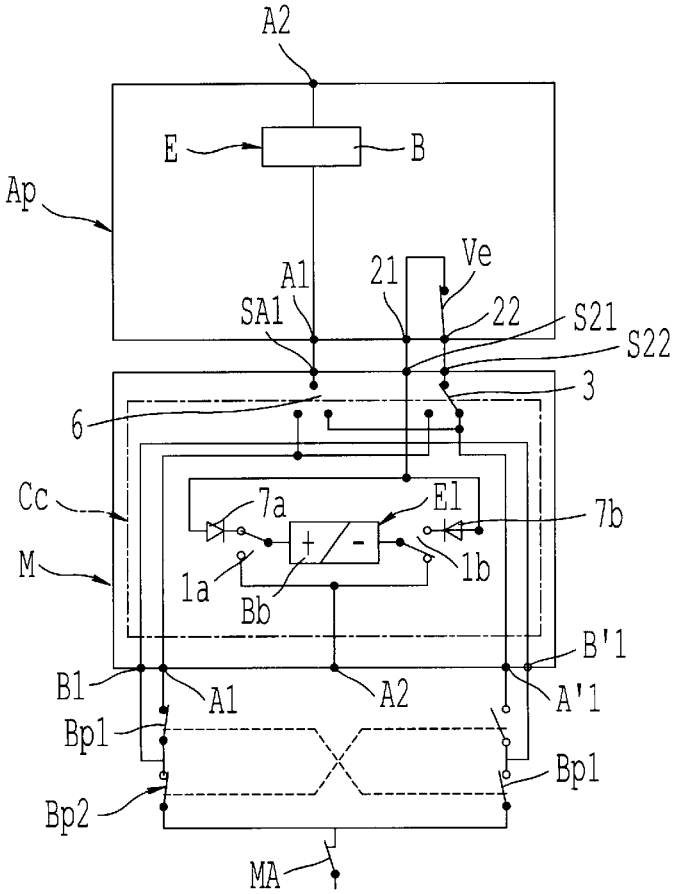
FIG. 10 is a diagram of an embodiment of the control circuit of the electromagnet of the module.

In the position shown in FIG. 10, electromagnet EI of main switching device Ap is powered via ON/OFF switch MA, contacts Bp1, Bp2 and 6. Power poles I1, I2 and I3 of main switching device Ap are in "direction one" operating position. The switching poles such as C1, C2 of switching module M are in the "direction one" operating position (these poles are always in the closed position).

In order to change to "direction two", the operator opens contact Bp2 and closes associated contact Bp2. Opening the contact cuts the power supply to coil B of main switching device Ap. Power switches I1 to I3 of main switching device Ap then open.

Closing contact Bp2 causes coil Bb of module M to be energized, thereby changing over switching contacts such as C1, C2. The auxiliary contacts of module M change over and power is routed to electromagnet E of main switching device Ap so that power switches I1–I3 are moved.

Electromagnet EI of switching module M can only change over when power contacts I1–I3 are open. This safety function is ensured by locking contact Ve. Moreover, power contacts I1–I3 close when the contacts of switching module M are in the correct position.

In order to avoid cutting the power supply while electromagnet EI is moving, the auxiliary contacts must change position after electromagnet EI has moved through all or most of its travel. A status-change delaying device may be associated with these three contacts.

It is clear that other versions and improvements can be imagined or equivalent means used without going outside the scope of the invention.

Another version could, for example, avoid using semiconductors (diodes or small protective components) in control circuit Cc.

What is claimed is:

1. Multipolar electromagnetic switching module designed to be connected by line connections (t1, t2, t3) to a main electromagnetic switching device (AP) and by load connections (U, V, W, u, v, w) to at least one motor and having, in a unit (Bo), between said connections, several load paths fitted with switching poles whose contacts are always alternately closed and controlled by a switching electromagnet (EI) driven by a control circuit, each of the switching poles (C1, C2, C3) consisting of a movable contact holder (Pc) between two conductors (Cf1, Cf2) bearing fixed contacts characterized in that, for each pole, the movable contact holder (Pc) comprises two parallel loop-shaped conductors (Cm1, Cm2) connected to a connection (T1, T2, T3) and that the two fixed contact components (Cf1, Cf2) are loop-shaped and connected to connections (U, V, W).

2. Module according to claim 1, characterized in that the conductors (Cm1, Cm2) of the contact holder are far enough apart from one another to enable a magnetic core (No) to be housed between them.

3. Module according to claim 2, characterized in that the magnetic core (No) operates in conjunction with counterplates (Cp1, Cp2) fastened inside the switching chamber housing the pole.

4. Module according to claim 1, characterized in that the parallel-loop shaped conductors (Cm1, Cm2) are connected by a flexible electrical link (Tr) to a connection.

5. Module according to claim 1, characterized in that the module is of the reverser type and comprises on one side line connections (t1, t2, t3) and on the other load connections (U, V, W).

6. Module according to claim 1, characterized in that the module is of the star-delta starter, distribution or speed-changer type and comprises on one side line connections (t1, t2, t3) and on the other load connections (U, V, W) for a first type of operation and load connections (u, v, w) for a second type of operation.

7. Module according to claim 1, characterized in that the contact holder (PM) is fitted with a pin-or-U-shaped pole spring (Rp) and operated by a slider (Ra) moved by an electromagnet (EI).

8. Module according to claim 2, characterized in that the parallel-loop shaped conductors (Cm1, Cm2) are connected by a flexible electrical link (Tr) to a connection.

9. Module according to claim 2, characterized in that the module is of the reverser type and comprises on one side line connections (t1, t2, t3) and on the other load connections (U, V, W).

10. Module according to claim 2, characterized in that the module is of the star-delta starter, distribution or speed-changer type and comprises on one side line connections (t1, t2, t3) and on the other load connections (U, V, W) for a first type of operation and load connections (u, v, w) for a second type of operation.

11. A multipolar electromagnetic switching module comprising:

a plurality of line connections configured to connect the switching module to a main electromagnetic switching device;

a plurality of load connections configured to connect the switching module to at least one motor;

a switching pole connected to one of said line connections and each of said load connections and configured to define a plurality of load paths between said one of said line connections and said load connections, said switching pole comprising:

a movable contact holder having parallel loop-shaped moveable contacts connected to said one of said line connections, two conductors positioned on opposing sides of said movable contact holder and having two loop shaped fixed contacts connected to each of said load connections; and a pole control assembly comprising a switching electromagnet driven by a control circuit, wherein said pole control assembly is configured to control said movable contact holder such that said movable contacts are alternately connected to each of said fixed contacts to thereby change a load path between said one of said line connections and said load connections.

* * * * *